US008181481B2

(12) United States Patent
Jager

(10) Patent No.: US 8,181,481 B2
(45) Date of Patent: May 22, 2012

(54) METHOD AND APPARATUS FOR COOLING A STREAM, IN PARTICULAR A HYDROCARBON STREAM SUCH AS NATURAL GAS

(75) Inventor: Marco Dick Jager, The Hague (NL)

(73) Assignee: Shell Oil Company, Houston, TX (US)

( * ) Notice: Subject to any disclaimer, the term of this patent is extended or adjusted under 35 U.S.C. 154(b) by 1247 days.

(21) Appl. No.: 11/562,671

(22) Filed: Nov. 22, 2006

(65) Prior Publication Data

US 2007/0175240 A1 Aug. 2, 2007

(30) Foreign Application Priority Data

Nov. 24, 2005 (EP) ..... 05111197

(51) Int. Cl.
*F25J 1/00* (2006.01)

(52) U.S. Cl. ..... 62/612; 62/613; 62/619; 62/196.2

(58) Field of Classification Search ..... 62/612, 62/613, 619, 196.2, 199, 228.5
See application file for complete search history.

(56) References Cited

U.S. PATENT DOCUMENTS

| | | | | |
|---|---|---|---|---|
| 5,826,444 | A | 10/1998 | Capron et al. | 62/612 |
| 6,041,619 | A | 3/2000 | Fischer et al. | 62/612 |
| 6,105,389 | A | 8/2000 | Paradowski et al. | 62/613 |
| 6,105,391 | A * | 8/2000 | Capron | 62/613 |
| 6,253,574 | B1 | 7/2001 | Stockmann et al. | |
| 6,289,692 | B1 | 9/2001 | Houser et al. | |
| 6,308,531 | B1 | 10/2001 | Roberts et al. | |
| 6,347,532 | B1 | 2/2002 | Agrawal et al. | |
| 2004/0134196 | A1 | 7/2004 | Jones, Jr. et al. | 60/772 |
| 2005/0056051 | A1 | 3/2005 | Roberts et al. | |
| 2008/0006053 | A1 * | 1/2008 | Bauer et al. | 62/612 |
| 2009/0019888 | A1 | 1/2009 | Bauer et al. | |

FOREIGN PATENT DOCUMENTS

| | | |
|---|---|---|
| AU | 4349385 | 12/1985 |
| EP | 1340951 | 9/2003 |
| EP | 1790926 | 5/2007 |

(Continued)

OTHER PUBLICATIONS

Perez V et al: "The 4.5 MMTPA LNG Train—A Cost Effective Design Train DE GNL DE 4.5 MMTPA—Une Conception Economique" International Conference and Exhibition on Liquefied Natural Gas, XX, XX, May 4, 1998, pp. 1-15, XP001212640. *p. 6, paragraph 1; figures 1,2,*.

(Continued)

*Primary Examiner* — Frantz Jules
*Assistant Examiner* — Azim Azim

(57) ABSTRACT

Method and apparatus for cooling a stream in a heat exchanger against a refrigerant fluid being cycled in a refrigerant circuit. The cycling of the refrigerant fluid includes feeding a first refrigerant fluid into an axial compressor and compressing it to obtain a compressed first refrigerant fluid. The compressed first refrigerant fluid is then fed into a centrifugal compressor, with a second refrigerant fluid. The compressed first refrigerant fluid and the second refrigerant fluid are compressed in the centrifugal compressor, thereby obtaining a compressed refrigerant fluid mixture. The compressed refrigerant fluid mixture is cooled in a heat exchanger and subsequently separated into at least two streams. The at least two streams are evaporated at different pressure levels of a heat exchanger in heat exchanging contact with the stream to be cooled, and from the at least two evaporated streams the first and second refrigerant fluids are retrieved.

12 Claims, 2 Drawing Sheets

FOREIGN PATENT DOCUMENTS

| | | |
|---|---|---|
| WO | WO 9713108 | 4/1997 |
| WO | 97/33131 | 9/1997 |
| WO | WO0144734 | 6/2001 |
| WO | WO2005057110 | 6/2005 |
| WO | WO 2007111595 | 10/2007 |

OTHER PUBLICATIONS

Khakoo M et al: "The Next Generation of LNG Plants La Nouvelle Generation Des Usines De Liquefaction" International Conference and Exhibition on Liquefied Natural Gas, May 14, 2001, pp. 1-14, XP 001212635 *p. 6, paragraph 5; figure 1* p. 9, paragraph 1; figure 3*.

Finn, A. J. et al., "Developments in Natural Gas Liquefaction", XP000825425, Hydrocarbon Processing, 1999.

Dr. Sib Akhtar, Slide pack "Driver Selection for LNG Compressors", MSE (Consultants) Ltd; Dec. 14, 2004.

Kikkawa, et al., "Optimize the Power System 1-18 of Baseload LNG Plant", Proceedings Gas Processors Assoc., GPA Mtg/Annual Convention, XX, XX, Mar. 14, 2001, XP009092082, p. 13, lines 1-3, Fig 3.4, Figs. 5.4, 5.5, 5.6; Examples A8, B9, C4.

Sawchuk, J., et al. "BP's Big Green Train—Next Generation LNG", Oct. 13, 2002, Gastech, pp. 1-11, XP001236100, p. 2, figure, p. 3, last paragraph, p. 9.

* cited by examiner

METHOD AND APPARATUS FOR COOLING A STREAM, IN PARTICULAR A HYDROCARBON STREAM SUCH AS NATURAL GAS

CROSS-REFERENCE TO RELATED APPLICATION

This application claims priority from European Patent Application No. 05111197.9, filed on Nov. 24, 2005, which is incorporated herein by reference.

FIELD OF THE INVENTION

The present invention relates to a method and apparatus for cooling a stream, in particular a hydrocarbon stream such as natural gas.

BACKGROUND OF THE INVENTION

In a known refrigerant circuit used in a method for cooling a hydrocarbon stream, e.g. in order to produce an LNG stream, the refrigerant is successively compressed in a compressor arrangement, cooled against e.g. water or air in a first heat exchanger, expanded and evaporated in a second heat exchanger (usually a cryogenic heat exchanger) where the refrigerant cools at least the natural gas stream to be cooled. The spent refrigerant leaving the second heat exchanger is again compressed, cooled and so on.

An example of a known method for cooling a hydrocarbon stream is disclosed in U.S. Pat. No. 5,826,444. U.S. Pat. No. 5,826,444 relates to a process and to a device allowing to liquefy a fluid or a gaseous mixture consisting at least partly of a mixture of hydrocarbons, for example natural gas.

The compressor arrangement used for compressing the refrigerant in the known refrigerant circuits usually comprises only one or more centrifugal compressors and no axial compressors, due to the fixed optimal pressure ratio of an axial compressor.

The above is even more true in the liquefaction of a natural gas stream using a mixed refrigerant evaporating in multiple cryogenic heat exchangers at multiple pressure levels in the refrigerant cycle, thereby resulting in various refrigerant streams at different pressure levels to be cycled back to the compressor arrangement for recompressing. Normally, axial compressors are not suitable to handle the typical pressure levels in a mixed refrigerant circuit with multiple cryogenic heat exchangers, due to the fixed optimal pressure ratios of the axial compressors.

SUMMARY OF THE INVENTION

The invention provides for a method of cooling a stream, wherein the stream is cooled in a heat exchanger against a refrigerant fluid being cycled in a refrigerant circuit, the cycling of the refrigerant fluid comprising:

(a) feeding a first refrigerant fluid into an axial compressor;

(b) compressing the first refrigerant fluid in the axial compressor, thereby obtaining a compressed first refrigerant fluid;

(c) feeding the compressed first refrigerant fluid at a first pressure level into a centrifugal compressor at a first inlet;

(d) feeding a second refrigerant fluid at a second pressure level into the centrifugal compressor at a second inlet, the second pressure level being lower than the first pressure level;

(e) compressing the compressed first refrigerant fluid fed in step (c) and the second refrigerant fluid fed in step (d) in the centrifugal compressor, thereby obtaining a compressed refrigerant fluid mixture;

(f) cooling the compressed refrigerant fluid mixture obtained in step (e) in a heat exchanger against a cooler stream, thereby obtaining a cooled compressed refrigerant fluid mixture;

(g) separating the cooled compressed refrigerant fluid mixture obtained in step (f) into at least two streams;

(h) evaporating the at least two streams obtained in step (g) at different pressure levels of a heat exchanger in heat exchanging contact with the stream to be cooled thereby cooling the stream; and (i) retrieving the first and second refrigerant fluids from the at least two streams evaporated in step (h).

BRIEF DESCRIPTION OF THE DRAWINGS

One or more embodiments of the invention are described in detail and by way of example only with reference to the accompanying drawings.

DETAILED DESCRIPTION OF THE INVENTION

Figure 1:
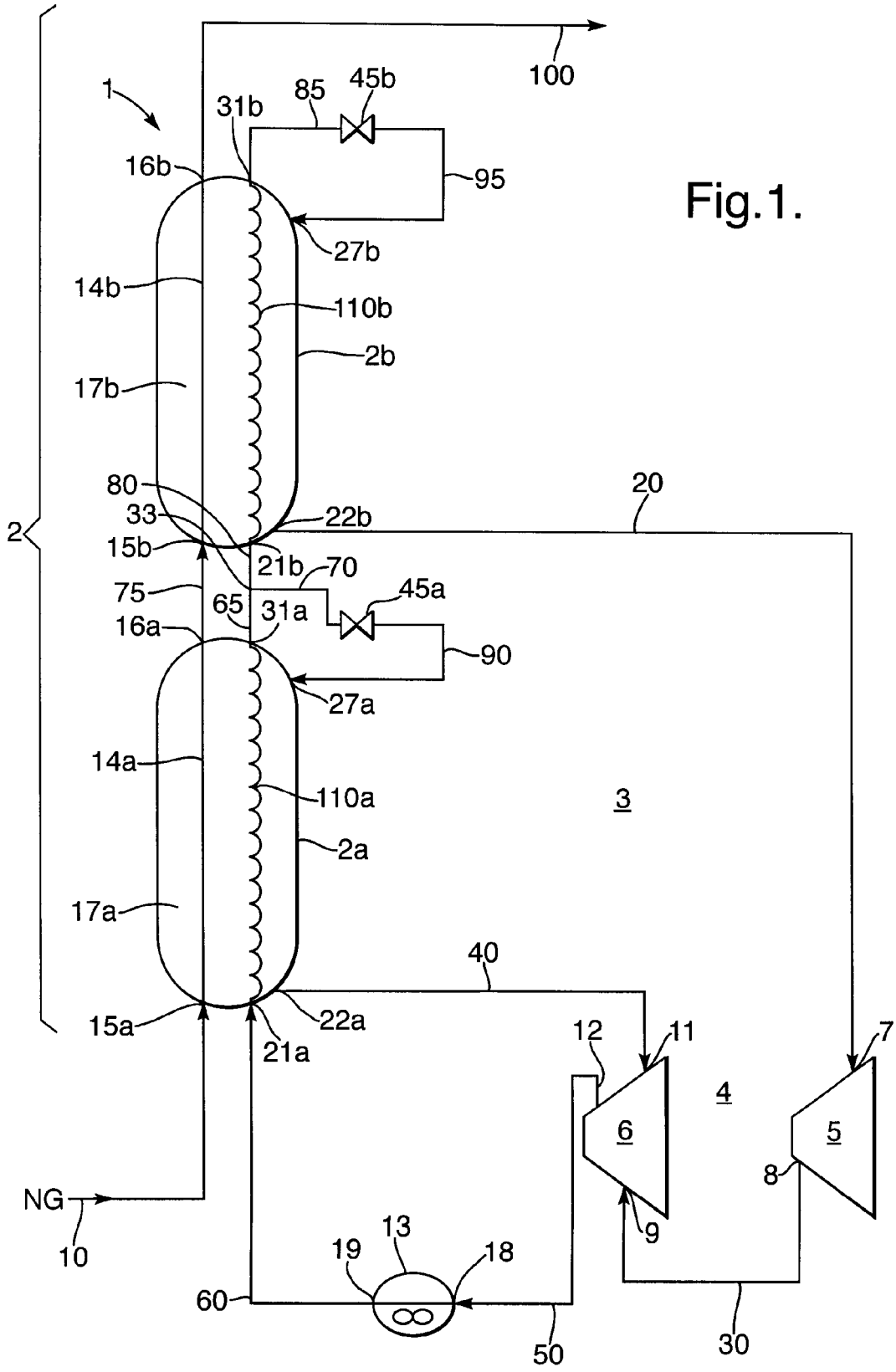
FIG. 1 shows a general schematic flow diagram of an apparatus of the invention for producing an LNG stream.

The present invention relates to a method and apparatus for cooling a stream, in particular a hydrocarbon stream such as natural gas.

In a further aspect the present invention relates to a compressor arrangement and in particular to the use thereof in a refrigerant circuit for use in a method and apparatus for producing a liquefied stream such as a liquefied hydrocarbon stream such as a liquefied natural gas (LNG) stream.

A problem of the use of known line-ups in the compressor arrangement is their inefficiency.

The present invention may minimize the above problem and may provide a more efficient method for producing a liquefied natural gas stream.

The present invention may provide an alternative compressor arrangement, in particular to be used in a refrigerant circuit using a mixed refrigerant with multiple cryogenic heat exchangers for cooling or liquefying a natural gas stream.

The present invention makes use of a surprisingly simple and flexible compressor arrangement containing a specific combination of an axial and a centrifugal compressor.

The invention provides for one or more of the following advantages.

An important advantage of the present invention is that—despite the presence of the axial compressor—a refrigerant fluid being composed of streams having different pressure levels and being cycled in a refrigerant circuit can be handled during compression in a surprisingly simple and efficient manner. This is in particular advantageous if a mixed refrigerant is used in the refrigerant circuit with multiple cryogenic heat exchangers.

A further advantage of the compressor arrangement used in the method according to the present invention, wherein an axial compressor is arranged partially parallel to a centrifugal compressor, is that a pressure ratio of about 6 across the axial compressor can be maintained while at the same time the compressor arrangement can handle various stream having different pressure levels.

Another advantage of the compressor arrangement used in the method according to the present invention is that a lower specific power is needed than if a single centrifugal compressor or two centrifugal compressors in series would be used.

An even further advantage of the present invention is that by use of the axial compressor the volumetric flow in any point of the centrifugal compressor in the compressor arrangement is significantly lowered.

As a method of cooling a stream such as a hydrocarbon stream, for example thereby producing an LNG stream is known as such, this is not fully discussed here in detail.

The person skilled in the art will understand that the stream to be cooled may have various compositions, but is preferably a hydrocarbon stream. The hydrocarbon stream may be any hydrocarbon-containing stream to be cooled, but is usually a natural gas stream obtained from natural gas or petroleum reservoirs. As an alternative the natural gas stream may also be obtained from another source, also including a synthetic source such as a Fischer-Tropsch process. Usually a natural gas stream is comprised substantially of methane. Preferably the natural gas comprises at least 60 mol % methane, more preferably at least 80 mol % methane. Depending on the source, the natural gas may contain varying amounts of hydrocarbons heavier than methane such as ethane, propane, butanes and pentanes as well as some aromatic hydrocarbons. The natural gas stream may also contain non-hydrocarbons such as $H_2O$, $N_2$, $CO_2$, $H_2S$ and other sulphur compounds, and the like. If desired, the natural gas stream may have been pre-treated before cooling. This pre-treatment may comprise removal of undesired components such as $H_2O$, $CO_2$ and $H_2S$, or other steps such as pre-cooling, pre-pressurizing or the like. As these steps are well known to the person skilled in the art, they are not further discussed here.

The refrigerant fluid being cycled in the refrigerant circuit may be a single component refrigerant or a mixed refrigerant containing several compounds having different boiling points. For use in the production of LNG, the refrigerant fluid will usually be selected from one or more of the group consisting of nitrogen; lower hydrocarbons such as methane, ethane, ethylene, propane, propylene, butane, pentane; or mixtures thereof thereby forming a mixed refrigerant. Preferably a mixed refrigerant is used as the refrigerant fluid.

The first and second refrigerant fluids being fed in steps (a) and (d) are not limited to a specific composition. They may contain different components or different mixtures of components or they may be parts of the refrigerant stream having the same composition.

The heat exchanger in which the natural gas stream is cooled may be a single heat exchanger or a heat exchanger train comprising two or more heat exchangers or heat exchanging zones, as long as the at least two streams obtained in step (g) can be evaporated at different pressure levels.

The separation of the cooled compressed refrigerant fluid mixture in step (g) may be performed in various ways, also depending on whether a single component refrigerant or a mixed refrigerant is used as the refrigerant fluid being cycled in the refrigerant circuit. If a mixed refrigerant is used, e.g. a T-junction may be used. If a single component is used, the separation may take place while the cooled compressed refrigerant fluid mixture obtained in step (f) passes through the heat exchanger or a zone thereof intended for cooling the natural gas stream in step (h). In the latter case, a part of the single component evaporates at a higher pressure level, while the remainder is passed to a lower pressure zone of the same or other heat exchanger and is evaporated there.

In a further aspect, the present invention provides an apparatus for cooling a stream, in particular a hydrocarbon stream such as natural gas, optionally producing a liquefied natural gas stream, wherein the stream is cooled in a heat exchanger against a refrigerant fluid being cycled in a refrigerant circuit, the refrigerant circuit at least comprising:

- a compressor arrangement comprising: an axial compressor having an inlet for a first refrigerant fluid to be compressed and an outlet for a compressed first refrigerant fluid; and a centrifugal compressor having a first inlet for the compressed first refrigerant fluid to be further compressed, a second inlet for a second refrigerant fluid to be compressed and an outlet for a compressed refrigerant fluid mixture, the centrifugal compressor being adapted such that the pressure level at the second inlet can be lower than the pressure level at the first inlet;
- a heat exchanger for cooling the compressed refrigerant fluid mixture against a cooler stream, thereby obtaining a cooled compressed refrigerant fluid mixture;
- a separator for separating the cooled compressed refrigerant fluid mixture into at least two streams;
- a heat exchanger in which the at least two streams can be evaporated at different pressures thereby cooling the stream;
- return lines for returning evaporated refrigerant to the compressor arrangement.

Preferably, the separator comprises a T-junction, in particular if a mixed refrigerant is the refrigerant fluid being cycled in the refrigerant circuit.

In an even further aspect the present invention provides a refrigerant circuit as described in the apparatus according to the present invention and the use thereof for cooling a stream, in particular natural gas.

In an other aspect the present invention provides a compressor arrangement as described in the apparatus according to the present invention, the compressor arrangement comprising:

- an axial compressor having an inlet for a fluid to be compressed and an outlet for a compressed fluid;
- a centrifugal compressor having a first inlet and a second inlet for fluids to be compressed and an outlet for a compressed fluid, the centrifugal compressor being adapted such that the pressure level at the second inlet can be lower than the pressure level at the first inlet;
- wherein the outlet of the axial compressor is connected to the second inlet of the centrifugal compressor.

The refrigerant circuit and compressor arrangement according to the present invention are not only suitable (and preferably intended) for cooling a natural gas stream, but may be used for any fluid to be cooled.

Figure 2:
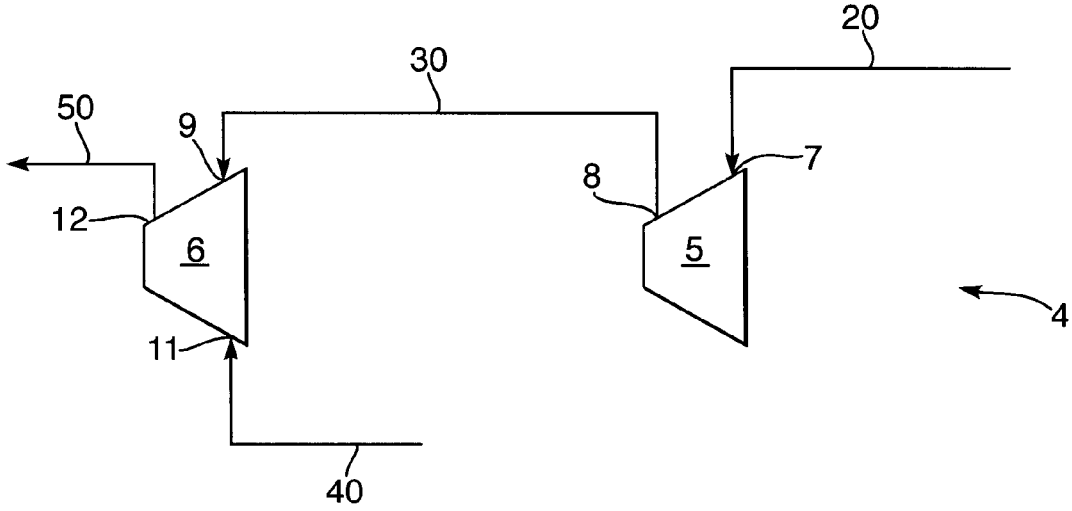
FIG. 2 shows schematically a compressor arrangement according to the present invention.
Figure 3:
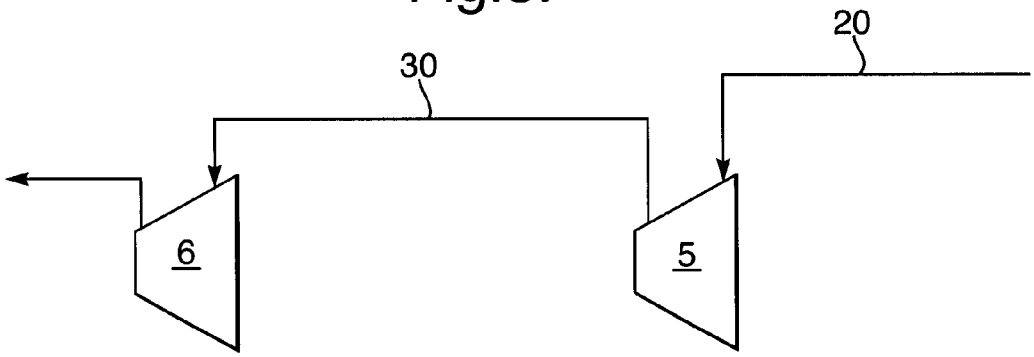
FIG. 3 (not according to the present invention) shows schematically a compressor arrangement wherein a centrifugal and an axial compressor are placed in series.

The invention will now be described by way of example in more detail with reference to the accompanying non-limiting drawings, wherein:

FIG. 1 shows a general schematic flow diagram of an apparatus of the invention for producing an LNG stream;

FIG. 2 shows schematically a compressor arrangement according to the present invention; and FIG. 3 (not according to the present invention) shows schematically a compressor arrangement wherein a centrifugal and an axial compressor are placed in series.

For the purpose of this description, a single reference number will be assigned to a line as well as a stream carried in that line. Same reference numbers refer to similar components.

Reference is made to FIG. 1. FIG. 1 schematically shows the apparatus 1 according to the present invention for liquefying a natural gas stream 10 using a mixed refrigerant being cycled in a refrigerant circuit 3. The mixed refrigerant suitably comprises a mixture of two or more of nitrogen, methane, ethane, propane and butane.

Although according to the embodiment of FIG. 1 a mixed refrigerant is used as the refrigerant fluid, the person skilled in the art will readily understand that also a single component refrigerant such as propane may be used instead.

The apparatus 1 comprises a heat exchanger train 2 comprising two or more heat exchangers (or heat exchanging zones) 2*a* and 2*b*, in which the natural gas stream 10 is cooled against a refrigerant being cycled in a refrigerant circuit 3. After cooling in the heat exchanger train 2, a cooled natural gas stream (which may be partly liquefied) 100 is obtained.

The person skilled in the art will readily understand that the apparatus may comprise more heat exchangers thereby cooling the natural gas stream 10 in several steps into liquefaction. As an example, the apparatus 1 may comprise a pre-cooling system with a pre-cooling refrigerant circuit, a main cryogenic system with a main refrigerant circuit and a sub-cooling system with a sub-cooling refrigerant circuit. However, for reasons of simplicity, only one cooling system with one refrigerant cycle has been shown in FIG. 1.

Further, the person skilled in the art will understand that the natural gas stream 10 may have been pre-treated, e.g. to remove any undesired components such as $H_2O$, $CO_2$, sulphur compounds such as $H_2S$, and the like.

The refrigerant circuit 3 comprises a specific compressor arrangement 4 being composed of an axial compressor 5 and a centrifugal compressor 6. If desired, the compressor arrangement 4 may comprise more than two compressors.

The axial compressor 5 has an inlet 7 for a first refrigerant fluid 20 to be compressed and an outlet 8 for a compressed first refrigerant fluid 30.

The centrifugal compressor 6 has a first inlet 9 for the compressed first refrigerant fluid 30 that has been compressed in the axial compressor 5 and a second inlet 11 for a second refrigerant fluid 40. If desired, stream 30 leaving the outlet 8 of the axial compressor 5 may be intermediately cooled against another stream (not shown) before passing to the inlet 9 of centrifugal compressor 6.

The compressed first refrigerant fluid 30 and the second refrigerant fluid 40 are concurrently compressed in the centrifugal compressor 5 thereby obtaining a compressed refrigerant fluid mixture 50 being removed from outlet 12.

Further the refrigerant circuit 3 comprises a heat exchanger 13 for cooling the compressed refrigerant fluid mixture 50 (which is fed via inlet 18) against a cooler stream, thereby obtaining a cooled compressed refrigerant fluid mixture 60 (which is removed via outlet 19). As an example, the heat exchanger 13 may be an air or water cooler, wherein air or water functions as the coolant.

The outlet 19 of the heat exchanger 13, in which the compressed refrigerant fluid mixture 50 has been cooled, is connected via line 60 to the first inlet 21*a* of the cold side 17*a* of the natural gas cooling heat exchanger 2*a*.

Furthermore, the apparatus 1 comprises a separator 33 for separating the cooled compressed refrigerant fluid mixture 65 into at least two streams. In the embodiment of FIG. 1, the separator 33 comprises a T-junction to obtain the at least two streams to be evaporated in the heat exchanger train 2. The separator 33 is placed between the first outlet 31*a* of the heat exchanger 2*a* (to be further discussed hereinafter) and the first inlet 21*b* of the heat exchanger 2*b*. One of the two streams is passed (as stream 70) to expander 45*a*, while the other stream (stream 80) is passed to the first inlet 21*b* of the heat exchanger 2*b* and subsequently passed (via line 110*b*) to first outlet 31*b* and expander 45*b*. The person skilled in the art will readily understand that the separator 33 may be placed on an other suitable location as long as at least two streams are obtained that can be evaporated in the heat exchanger train 2 at different pressure levels. Preferably the separator 33 is placed somewhere between the first outlet 31*a* of the heat exchanger 2*a* and the first inlet 21*b* of the heat exchanger 2*b*. Also, the cooled compressed refrigerant fluid mixture 65 may be split into more than two streams, if desired.

The two streams 70, 80 obtained as described above are evaporated at different locations and at different pressure levels in the heat exchanger train 2 thereby cooling the natural gas stream 10. In the embodiments shown in FIG. 1, one of the above two streams is evaporated in heat exchanger 2*a*, while the other one is evaporated in heat exchanger 2*b*, wherein the stream being evaporated in heat exchanger 2*a* is evaporated at a higher pressure and temperature than the stream being evaporated in heat exchanger 2*b*. If the heat exchanger train 2 comprises further heat exchangers 2*c*, 2*d*, etc, the temperature and pressure at which the respective streams are evaporated preferably will decrease, going from heat exchanger 2*a* to 2*b* to 2*c*, etc.

The natural gas cooling heat exchangers 2*a*, 2*b* have a hot side schematically shown in the form of tubes 14*a*, 14*b* having inlets 15*a*, 15*b* for natural gas 10 and outlets 16*a*, 16*b* for cooled natural gas. The tubes 14*a*, 14*b* are arranged in the cold side 17*a*, 17*b*, which can be a shell side of the natural gas cooling heat exchangers 2*a*, 2*b*. The outlet 16*a* of heat exchanger 2*a* is connected via line 75 to inlet 15*b* of heat exchanger 2*b*.

In the embodiment of FIG. 1 the heat exchangers 2*a*, 2*b* also comprise conduits 110*a*, 110*b* for transporting the respective refrigerant streams through the respective heat exchanger, from the first inlets 21*a*, 21*b* to the first outlets 31*a*, 31*b*.

The stream 65 removed from the first outlets 31*a* is split in separator 33 into the streams 70 and 80. Stream 80 is passed to the first inlet 21*b* of the heat exchanger 2*b*, whilst stream 70 is expanded in expander 45*a* and returned (as stream 90) via second inlet 27*a* into the heat exchanger 2*a* in which it is evaporated. The evaporated stream is collected at second outlet 22*a* at the bottom of the heat exchanger 22*a*.

The stream 80 is fed at first inlet 21*b* into heat exchanger 2*b*, passed through the heat exchanger as stream 110*b* and removed from the heat exchanger 2*b* at the first outlet 31*b* as stream 85. Subsequently, stream 85 is expanded in expander 45*b* and returned via line 95 at second inlet 27*b* into the heat exchanger 2*b* in which it is evaporated. The evaporated stream is collected at second outlet 22*b* near the bottom of the heat exchanger 2*b*.

If a further heat exchanger 2*c* is present, then the stream 85 removed from outlet 31*b* of heat exchanger 2*b* may be further split in a suitable manner. One of the streams obtained then would be used as a feed to the expander 45*b*, whilst (one of) the other stream(s) could be used as a feed for the heat exchanger 2*c*.

The second outlet 22 of the cold side 17*a* is connected by means of return conduit 40 to the second inlet 11 of the centrifugal compressor 6. The second outlet 22*b* of the cold side 17*b* is connected by means of return conduit 20 to the inlet 7 of axial compressor 5. Usually, knock out drums (not shown) are present in the lines 20, 40 to prevent that liquid is fed into the compressors 5, 6.

During normal operation, natural gas 10 is supplied to the cooling heat exchanger train 2, is stepwise cooled in heat exchangers 2*a*, 2*b* against the refrigerant being cycled in the circuit 3 as described above, and is removed as a cooled fluid 100 from the heat exchanger 2*b* at outlet 16*b*.

Generally, the second refrigerant fluid 40 has a higher pressure than the first refrigerant fluid 20. Preferably, the first refrigerant fluid 20 is fed into the axial compressor 5 at a pressure in the range of 2-5 bar, preferably about 3 bar. Also it is preferred that the compressed first refrigerant fluid 30 is fed into the centrifugal compressor 6 at a pressure in the range of 12-30 bar. It is even more preferred that the pressure of the compressed first refrigerant fluid 30 that is fed into the centrifugal compressor 6 is five to seven times as high as the pressure of the first refrigerant fluid 20 that is fed into the axial compressor 5, preferably about 6 times as high. Also it is preferred that the second refrigerant fluid 40 is fed into the centrifugal compressor 6 at a pressure in the range of 6-15 bar and that the compressed refrigerant fluid mixture 50 has a pressure in the range of 25-60 bar. Furthermore the com pressed first refrigerant fluid 30 is at a higher pressure than the second refrigerant fluid 40.

If the refrigerant circuit 3 is used for pre-cooling or liquefaction purposes, the temperature at the first inlet 21*a* of heat exchanger 2*a* will generally be in the range of from 50 to −50° C.; the temperature at the first outlet 31*a* of heat exchanger 2*a* will be in the range of from 20 to −80° C. Further, the temperature at the first inlet 21*b* of heat exchanger 2*b* will generally be in the range of from 20 to −80° C.; the temperature at the first outlet 31*b* of heat exchanger 2*b* will be in the range of from 0 to −110° C.

FIG. 2 shows schematically the compressor arrangement 4 according to the present invention, while FIG. 3 shows a compressor arrangement wherein an axial compressor and a centrifugal compressor are placed in series. As can be clearly seen from the FIGS. 2 and 3, the refrigerant stream being compressed in the compressor arrangement of FIG. 3 must have a single pressure. In other words, the arrangement according to FIG. 3 is—contrary to the arrangement 4 according to the present invention as shown in FIG. 2—not suitable for compressing a refrigerant stream that is composed from different streams having different pressures.

The following Example is used to further illustrate the present invention.

EXAMPLE

In a calculated simulation, the process scheme of FIG. 1 was used as a pre-cooling step in the liquefaction of 10 kgmol/s natural gas having a molecular weight of 18 g/mol (i.e. 180 kg/s feed, equivalent to approximately 5 Mtpa LNG to be produced eventually).

Otherwise than the process scheme indicated in FIG. 1, an additional intermediate cooling step of the stream 30 between the outlet 8 of the axial compressor 5 and the first inlet 9 of the centrifugal compressor 6 was performed. The cooled stream 30 (fed into first inlet 9 of compressor 6) is referred to in Table 2 below with stream No. 35 (not shown in FIG. 1).

For the simulation the specifications of axial compressor K1430 and of centrifugal compressor K1440 were used.

Table 1 shows the temperature, pressure, flow rate and phase condition of the various natural gas streams in a simulated example, whilst Table 2 shows the same for the various streams within the refrigerant cycle. In the simulated example, stream 60 comprises 1.8 mol % methane, 50.8 mol % ethane and 47.4 mol % propane.

TABLE 1

Process conditions of natural gas in a simulated example.

| | Stream no. | | |
|---|---|---|---|
| | 10 | 75 | 100 |
| Temperature [° C.] | 40 | −11.6 | −51.0 |
| Pressure [bar] | 54 | 52 | 50 |
| Flow rate [kgmol/s] | 10.00 | 10.00 | 10.00 |
| Phase* | V | V | M |

*L = liquid; V = vapour; M = mixed.

TABLE 2

Process conditions of streams in refrigerant cycle in a simulated example.

| | Stream no. | | | | | | | | | | | |
|---|---|---|---|---|---|---|---|---|---|---|---|---|
| | 20 | 30 | 35 | 40 | 50 | 60 | 65 | 70 | 80 | 85 | 90 | 95 |
| Temperature [° C.] | −14.6 | 75.3 | 43.0 | 37.6 | 100.7 | 40.0 | −11.6 | −11.6 | −11.6 | −51.0 | −15.6 | −54.3 |
| Pressure [bar] | 3.2 | 19.2 | 18.9 | 10.4 | 36.1 | 34.7 | 32.7 | 32.7 | 32.7 | 30.7 | 10.6 | 3.4 |
| Flow rate [kgmol/s] | 6.54 | 6.54 | 6.54 | 11.99 | 18.53 | 18.53 | 18.53 | 11.99 | 6.54 | 6.54 | 11.99 | 6.54 |
| Phase* | V | V | V | V | V | L | L | L | L | L | M | M |

*L = liquid; V = vapour; M = mixed.

From further calculations it followed that the pre-cool cycle as used in the Example resulted in an efficient pre-cooling cycle. As can be seen from Table 3 an increase (268.1/271.3×100%=0.99%) of combined power would result if the compressor arrangement 4 according to the present invention is replaced by two centrifugal compressors in series. As a result of the increased power, also a decrease in Coefficient of performance (CoP—defined as the ratio between the heat transferred from the natural gas and other fluids to be cooled (180.5 MW in the Example) and the power invested in the cycle (respectively 87.6 and 90.8 MW)) would result: 2.06 vs. 1.99.

TABLE 3

Comparison of combined power.

| | | Compressor arrangement of present invention | Compressor arrangement consisting of 2 centrifugal compressors in series |
|---|---|---|---|
| Energy added to refrigerant | Total work of compressors 5 and 6 [MW] | 87.6 | 90.8 |
| | Heat transferred from 14b [MW] | 130.6 | 130.6 |
| | Heat transferred from 14a [MW] | 49.9 | 49.9 |
| | Balance [MW] | 268.1 | 271.3 |

TABLE 3-continued

| Comparison of combined power. | | | |
|---|---|---|---|
| | | Compressor arrangement of present invention | Compressor arrangement consisting of 2 centrifugal compressors in series |
| Energy rejected by refrigerant | Duty of heat exchanger 13 [MW] | 268.1 | 271.3 |
| | Balance [MW] | 0 | 0 |
| CoP | | 2.06 | 1.99 |

The person skilled in the art will readily understand that the present invention can be modified in many various ways without departing from the scope of the appended claims. As an example, stream 50 may be heat exchanged against another stream.

What is claimed is:

1. A method of cooling a stream, wherein the stream is cooled in a heat exchanger train against a refrigerant fluid being cycled in a refrigerant circuit, the cycling of the refrigerant fluid comprising:

(a) feeding a first refrigerant fluid into an axial compressor;

(b) compressing the first refrigerant fluid in the axial compressor, thereby obtaining a compressed first refrigerant fluid;

(c) feeding the compressed first refrigerant fluid at a first pressure level into a centrifugal compressor at a first inlet;

(d) feeding a second refrigerant fluid at a second pressure level into the centrifugal compressor at a second inlet, the second pressure level being lower than the first pressure level;

(e) compressing the compressed first refrigerant fluid fed in step (c) and the second refrigerant fluid fed in step (d) in the centrifugal compressor, thereby obtaining a compressed refrigerant fluid mixture;

(f) cooling the compressed refrigerant fluid mixture obtained in step (e) in a heat exchanger against a cooler stream, thereby obtaining a cooled compressed refrigerant fluid mixture;

(g) separating the cooled compressed refrigerant fluid mixture obtained in step (f) into at least two streams;

(h) evaporating the at least two streams obtained in step (g) at different pressure levels in the exchanger train, in heat exchanging contact with the stream to be cooled thereby cooling the stream; and retrieving the first and second refrigerant fluids from the at least two streams evaporated in step (h).

2. The method according to claim 1, wherein the pressure level of the second refrigerant fluid fed in step (d) is higher than the pressure level of the first refrigerant fluid fed in step (a).

3. The method according to claim 1, wherein the first refrigerant fluid is fed into the axial compressor in step (a) at a pressure in the range of 2-5 bar.

4. The method according to claim 1, wherein the compressed first refrigerant fluid is fed into the centrifugal compressor in step (c) at a pressure in the range of 12-30 bar.

5. The method according to claim 1, wherein the pressure of the compressed first refrigerant fluid that is fed into the centrifugal compressor in step (c) is 5-7 times as high as the pressure of the first refrigerant fluid that is fed into the axial compressor in step (a).

6. The method according to claim 1, wherein the second refrigerant fluid is fed into the centrifugal compressor in step (d) at a pressure in the range of 6-15 bar.

7. The method according to claim 1, wherein the compressed refrigerant fluid mixture obtained in step (e) has a pressure in the range of 25-60 bar.

8. The method according to claim 1, wherein the refrigerant fluid comprises a mixed refrigerant.

9. The method according to claim 1, wherein the stream cooled in step (h) is liquefied thereby obtaining a liquefied stream.

10. The method according to claim 1, wherein the stream is a hydrocarbon stream.

11. An apparatus for cooling a stream, wherein the stream is cooled in a heat exchanger against a refrigerant fluid being cycled in a refrigerant circuit, the cycling of the refrigerant fluid comprising:

an axial compressor comprising an inlet for a first refrigerant fluid to be compressed and an outlet for a compressed first refrigerant fluid;

a centrifugal compressor comprising a first inlet arranged to receive the compressed first refrigerant fluid at a first pressure level to be further compressed, and comprising a second inlet for a second refrigerant fluid to be compressed, and an outlet for a compressed refrigerant fluid mixture, whereby the pressure level at the second inlet is lower than the first pressure level at the first inlet;

a heat exchanger for cooling the compressed refrigerant fluid mixture against a cooler stream, thereby obtaining a cooled compressed refrigerant fluid mixture;

a separator for separating the cooled compressed refrigerant fluid mixture into at least two streams;

a heat exchanger train for evaporating the at least two streams obtained in step at different pressure levels in heat exchanging contact with the stream to be cooled thereby cooling the stream; and first and second outlets from the heat exchanger train for retrieving the first and second refrigerant fluids from the at least two evaporated streams.

12. The apparatus of claim 11, wherein the heat exchanger train comprises at least two heat exchangers.

* * * * *